US006398121B1

(12) United States Patent
Morgan

(10) Patent No.: US 6,398,121 B1
(45) **Date of Patent: *Jun. 4, 2002**

(54) TOY TRAIN TRACKS

(76) Inventor: Barry Z. Morgan, 47 Ward La., Stamford, CT (US) 06907

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 75 days.

(21) Appl. No.: 09/501,455

(22) Filed: Feb. 10, 2000

(51) Int. Cl.[7] ..... A63H 18/02

(52) U.S. Cl. ..... 238/10 F; 238/10 R; 238/10 E; 238/10 B

(58) Field of Search ..... 238/10 F, 10 R, 238/10 E, 10 B, 83; 446/444, 445

(56) References Cited

U.S. PATENT DOCUMENTS

| | | | | | |
|---|---|---|---|---|---|
| 3,013,726 | A | * | 12/1961 | Orel | 238/10 |
| 3,750,945 | A | * | 8/1973 | Warr | 238/10 E |
| 3,961,751 | A | * | 6/1976 | Kessler | 238/10 R |
| RE30,454 | E | * | 12/1980 | Birdsall | 238/10 F |
| 4,397,419 | A | * | 8/1983 | Fischer | 238/10 F |
| 4,540,119 | A | * | 9/1985 | Neuhierl | 238/10 R |
| 4,544,094 | A | * | 10/1985 | Scholey | 238/10 R |
| 4,681,482 | A | * | 7/1987 | Arciszewski et al. | 404/35 |
| 5,678,489 | A | * | 10/1997 | Wang | 104/56 |
| 5,779,145 | A | * | 7/1998 | Zelle et al. | 238/10 E |
| 5,979,783 | A | * | 11/1999 | Toht et al. | 238/10 E |

FOREIGN PATENT DOCUMENTS

| | | | | |
|---|---|---|---|---|
| DE | 3440875 A1 | * | 5/1986 | A63H/18/02 |
| SE | 33396 | * | 10/1997 | 238/10 |

OTHER PUBLICATIONS

Copy of product packaging for Discovery Toys "Zip Track Flexible Speedway".

* cited by examiner

*Primary Examiner*—S. Joseph Morano
*Assistant Examiner*—Frantz F. Jules
(74) *Attorney, Agent, or Firm*—Cummings & Lockwood; George N. Chaclas

(57) ABSTRACT

A track section for use on a substantially planar surface including a plurality of spaced segments, each of the plurality of spaced segments defining at least one groove in at least one surface thereof, each of the plurality of spaced segments defining an orifice to receive a cable captured by a first end connector on a first end and captured by a second end connector on a second end and wherein the track section flexes on the substantially planar surface.

12 Claims, 5 Drawing Sheets

TOY TRAIN TRACKS

BACKGROUND OF THE INVENTION

1. Field of the Disclosure

The subject disclosure relates to children's toy train sets, and more particularly to an improved flexible track.

2. Background of the Related Art

Many variations of toy train sets have been suggested in the past. Techniques for fabrication have included using wood, plastic, metal or a combination of the same. Typically, toy train sets are assembled and played with either on the floor or a table.

Generally, wooden toy train sets include sections of wood toy train track which are of various shapes and sizes. A young child needs to easily interconnect the various shapes and sizes to form the desired pattern over which to roll the toy train. The more sophisticated and complex the track pattern becomes, the more the child enjoys assembly and play therewith.

Toy train tracks are commercially available from a multitude of companies such as BRIO® Corporation having an office in Milwaukee, Wis. and Learning Curve International, L.L.C. of Chicago, Ill. Track sections available from these and other companies include straight as well as curved sections, cross and switch sections, as well as ascending and descending track sections. Bridges, ramps and track supports of various kinds are often provided to allow elevating the track sections. Toy train track components and systems are described in the patent literature, e.g., U.S. Pat. No. 4,841,104 to Adell and U.S. Pat. No. 6,009,812 to Ernst.

Suspension bridges have been developed to interconnect with wooden toy train track sections. Generally, a suspension bridge has a pair of stanchions for supporting each end of a suspension bridge section. In a suspension bridge (commercially available from BRIO® Corporation of Milwaukee), the suspension bridge section has a plurality of segments fixed in place by two lengths of cord disposed through a series of holes aligned in parallel in the segments. As a result, the suspension bridge section has a limited ability to flex in a vertical direction.

In view of the above, there are opportunities to improve based upon the prior art of toy train tracks. For example, previous track sections required many expensive specialized pieces to create desired shapes. Therefore, a need exists for an improved toy train track section that permits easy and efficient track assembly and can solve problems of mismatch.

SUMMARY OF THE INVENTION

The present invention provides a toy track section for play on a substantially planar surface including a plurality of spaced segments. Each of the plurality of spaced segments defines at least one groove in at least one surface thereof and an orifice formed therethrough. A cable extends through the orifices formed through the plurality of segments. A first end connector captures a first end of the cable and a second end connector captures a second end of the cable. The cable permits the plurality of segments to flex relative to each other on the substantially planar surface.

Another embodiment of the present invention includes a toy track which includes a plurality of elongated segments. Each of the plurality of elongated segments has opposed upper and lower surfaces and an outer peripheral wall extending between the upper and lower surfaces defining opposing lateral wall portions. Each of the plurality of elongated segments also has a length along a first axis and a width along a second axis. The first axis is substantially perpendicular to the second axis and each of the plurality of segments is adapted and configured to allow the toy track section to flex in a plane defined by the first axis and the second axis.

These and other unique features of the system disclosed herein will become more readily apparent from the following description, the accompanying drawings and the appended claims.

BRIEF DESCRIPTION OF THE DRAWINGS

So that those having ordinary skill in the art to which the disclosed system appertains will more readily understand how to make and use the same, reference may be had to the drawings wherein.

DETAILED DESCRIPTION OF PREFERRED EMBODIMENTS

The present disclosure overcomes many of the prior art problems associated with toy train tracks. The advantages, and other features disclosed herein, will become more readily apparent to those having ordinary skill in the art from the following detailed description of certain preferred embodiments taken in conjunction with the drawings which set forth representative embodiments of the present invention.

Figure 1A:
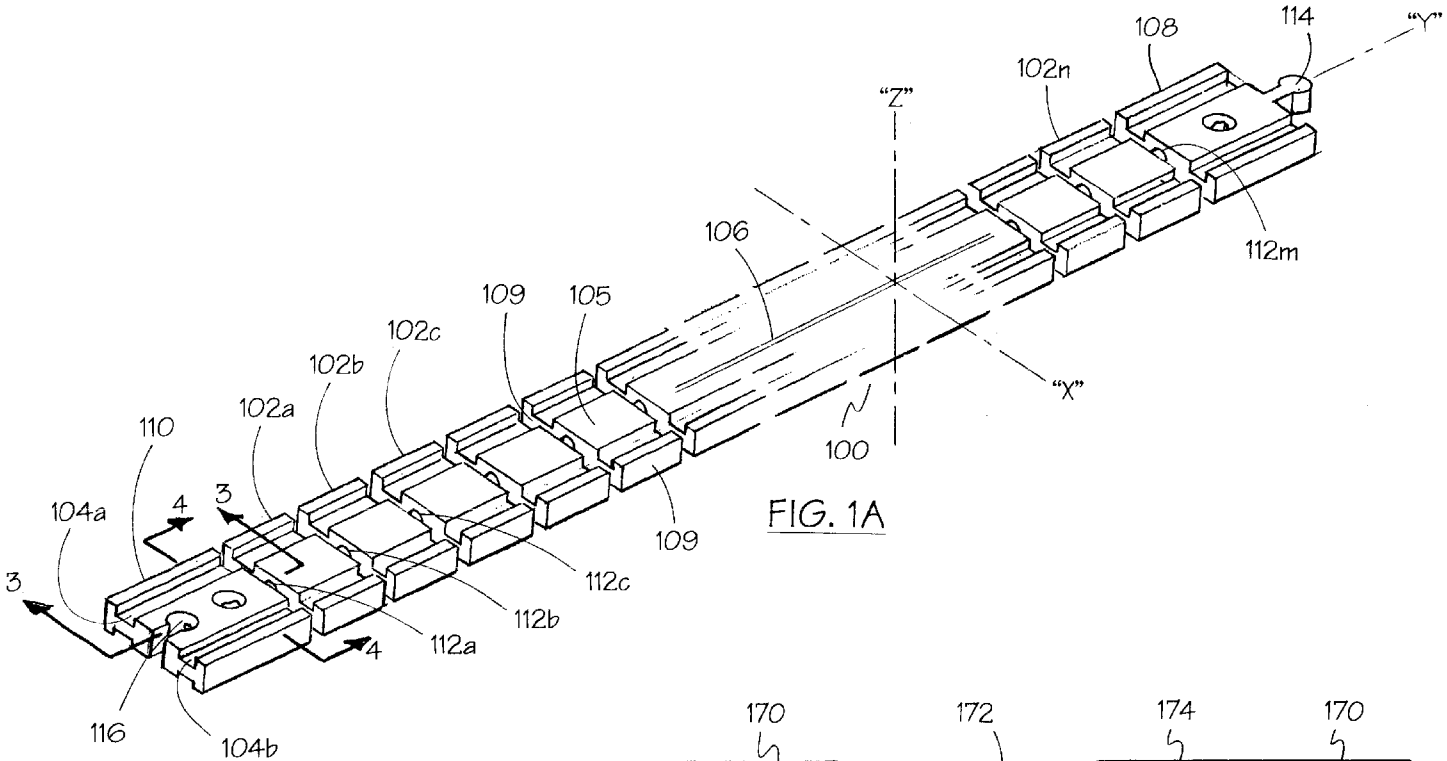
FIG. 1A illustrates a perspective view of a first embodiment of a toy train track section according to the present disclosure.

Referring to FIG. 1A, a first embodiment of a toy train track section generally designated 100 is illustrated. Section 100 has a plurality of segments 102(*a*)–(*n*) which collectively form two grooves 104*a* and 104*b* for the opposing wheels of a toy train to ride within. A cable 106 secures and aligns each segment 102(*a*)–(*n*) in position along axis "y". Furthermore, each segment 102(*a*)–(*n*) can independently rotate about cable 106. Collars 112(*a*)–(*m*) (wherein m=n+1) create spacing between segments 102(*a*)–(*n*). The variables "n" and "m" represent the numbers of segments 102 and collars 112, respectively, and are in no way intended to limit the potential length of toy train track segment 100. In a preferred embodiment, segments 102(*a*)–(*n*) are made from wood, cable 106 is made from a nonelastic material such as stainless steel or the like and collars 112 are made from a molded plastic. In an alternative embodiment, no collars are provided and the spacing of individual segments 102(*a*)–(*n*) is not uniform in nature. Segments 102(*a*)–(*n*) have opposed upper and lower surfaces, 105 and 107, respectively. An outer peripheral wall 109 extends between the upper surface 105 and the lower surface 107.

Still referring to FIG. 1A, section 100 terminates in male and female connectors 108 and 110, respectively. Male connector 108 has a protrusion 114 for engaging a bore in a female end connector, e.g., of an adjoining track section. Female connector 110 has a bore 116 for receiving a protrusion in a male end connector of an adjoining track section. Therefore, by varying the length and combination of end connectors, section 100 can be easily integrated with any combination of similar or complimentary train track sections.

Figure 1B:
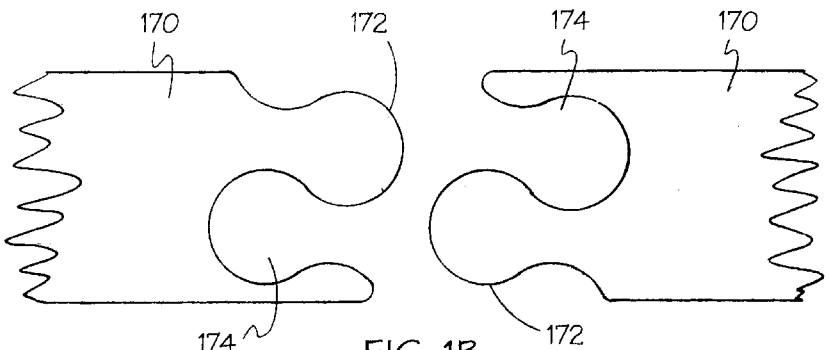
FIG. 1B illustrates a top view of alternative end connectors for an embodiment of a toy train track section according to the present disclosure.
Figure 2:
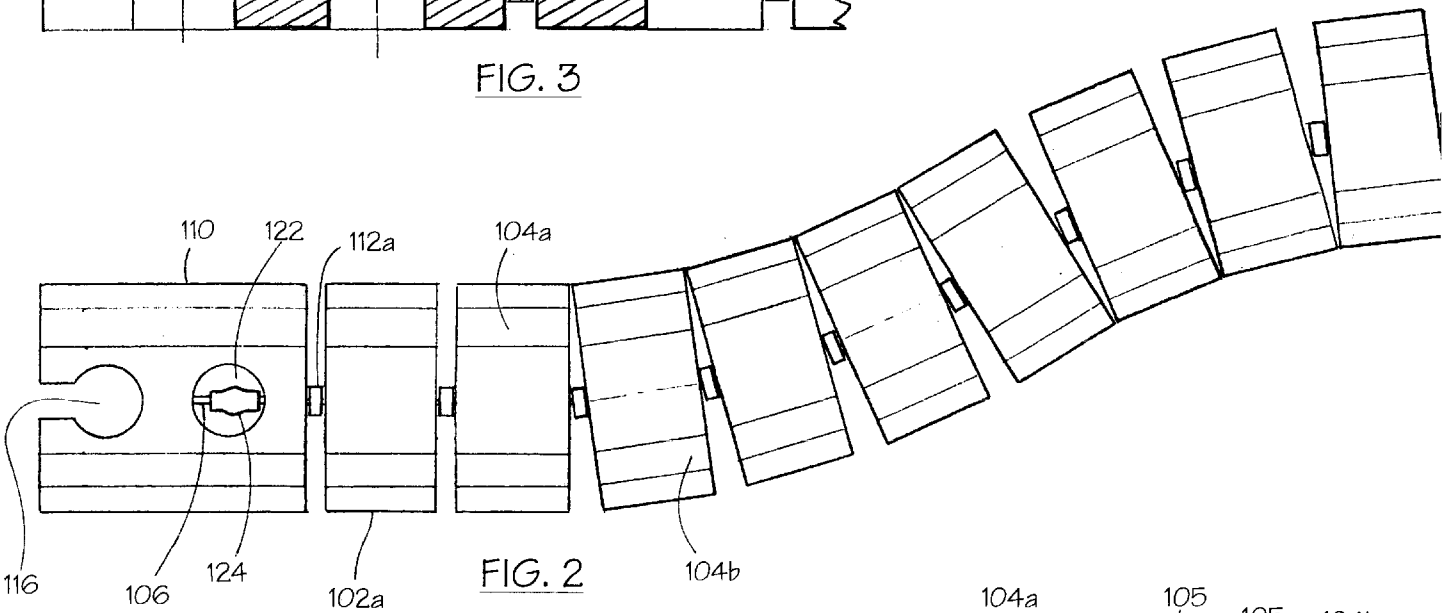
FIG. 2 illustrates a top view of a first embodiment of a toy train track section according to the present disclosure.

Referring now to FIG. 1B, a top view of alternative end connectors is illustrated. End connectors 170 are unisex and identical. Each end connector 170 has a finger 172 and defines a cavity 174 to capture the finger 172 of an adjacent track section. Additionally, track sections may terminate in segments having opposing hook and loop locking fabric or magnets located on end connectors in order to sufficiently engage adjoining segments Referring now to FIG. 2, a top view of a first embodiment, according to FIG. 1A, illustrates the flexibility of section 100. Section 100 can be shaped into lines, semi-circles, sinewaves and like arcs, and may be used in combination with other segments, e.g., segments fabricated according to conventional techniques and according to the present disclosure to create a desired pattern. Despite flexing of section 100 in a horizontal plane defined by axis "x" and "y" in FIG. 1A, grooves 104*a* and 104*b* still effectively guide opposing wheels of a toy across each segment 102(*a*)–(*n*) of section 100.

Figure 3:
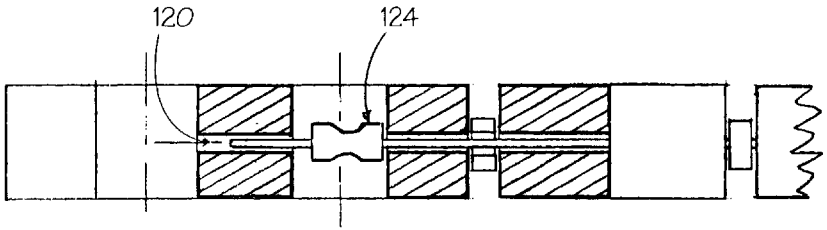
FIG. 3 illustrates a cross-section view taken along line 3—3 of FIG. 1A.
Figure 4:
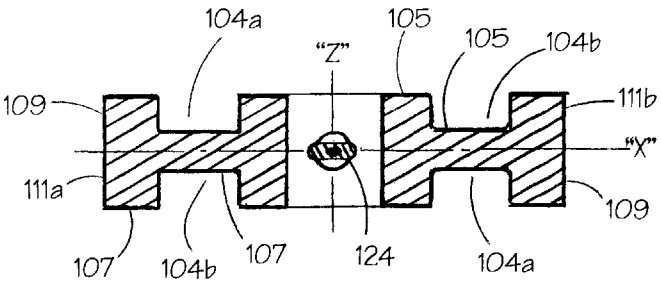
FIG. 4 illustrates a cross-section view taken along line 4—4 of FIG. 1A.

Referring now to FIGS. 1–4, cross-sectional views along lines 3—3 and 4—4 of FIG. 1A are illustrated in FIG. 3 and FIG. 4, respectively. Female connector 110 includes a hole 120, which receives cable 106 and intersects aperture 122. A cable stop sleeve 124 is crimped onto cable 106 within aperture 122. As a result, the end of cable 106 is securely located within hole 120 between aperture 122 and bore 116. Therefore, the end of cable 106 will not scratch or be accessible by a child playing with section 100. Cable stop sleeve 124 may be fabricated from a variety of material, e.g., brass, steel, aluminum and the like. Although not shown, the other end of cable 106 is similarly captured within male connector 108.

Referring now to FIG. 4, grooves 104*a* and 104*b* are formed in the top and bottom side of female connector 110 to create symmetry about the "x" axis. Therefore, even though female connector 110 may rotate about cable 106, alignment of grooves 104*a* and 104*b* will still be maintained with adjacent segments. Moreover, male connector and segments 102(*a*)–(*n*) are symmetrical about the "x" axis. Therefore, grooves 104*a* and 104*b* effectively guide opposing wheels of a toy across the entire length of section 100 regardless of which grooved sides of segments 102(10)–(*n*) are upwardly positioned. When the segments 102(*a*)–(*n*) are rectangular as shown, the outer peripheral wall defines opposing lateral wall portions. As shown, outer peripheral wall portions 111*a* and 111*b* form opposing sides of the segments. As will be appreciated by those skilled in the art upon review of the subject disclosure, the portions of the outer peripheral wall 109 between portions 111*a* and 111*b* will also form opposing lateral wall portions.

In another embodiment, a track section may consist of a single symmetrical substantially rectangular segment. Thus, ease of assembly is facilitated because a small child does not need to orient a particular side upwardly. Further, engagement of male and female end connectors in not required because the single symmetrical substantially rectangular segments simply abut each other. It is envisioned that the single symmetrical substantially rectangular segment may be adapted and configured to engage other segments with end connectors, hook and loop locking fabric, magnets or the like.

Still referring to FIG. 4, it is also envisioned that each segment may be of two-piece construction. For example, the two pieces may comprise segment portions above and below the "x" axis; thus, each piece would be identical. Preferably, the two pieces may be adhered to each other, e.g., with a glue or other adhesive, and hole 120 may be drilled therein. Additionally, it is envisioned that two piece end connectors may sandwich the end of cable 106 between the two pieces, thereby simplifying the cable retention method and reliably securing the cable end.

Furthermore, it will be appreciated that a cross-section profile may have different groove configurations which are symmetrical about the "x" axis. For example, a single groove or three grooves may be provided in order to accommodate a ball or a tricycle, respectively. It is envisioned that many types of toys may be adapted to travel upon the toy track disclosed herein. Some examples include, but are by no means are limited to, animals, bobsleds, buses, cars, people, trucks and vans.

Figure 5:
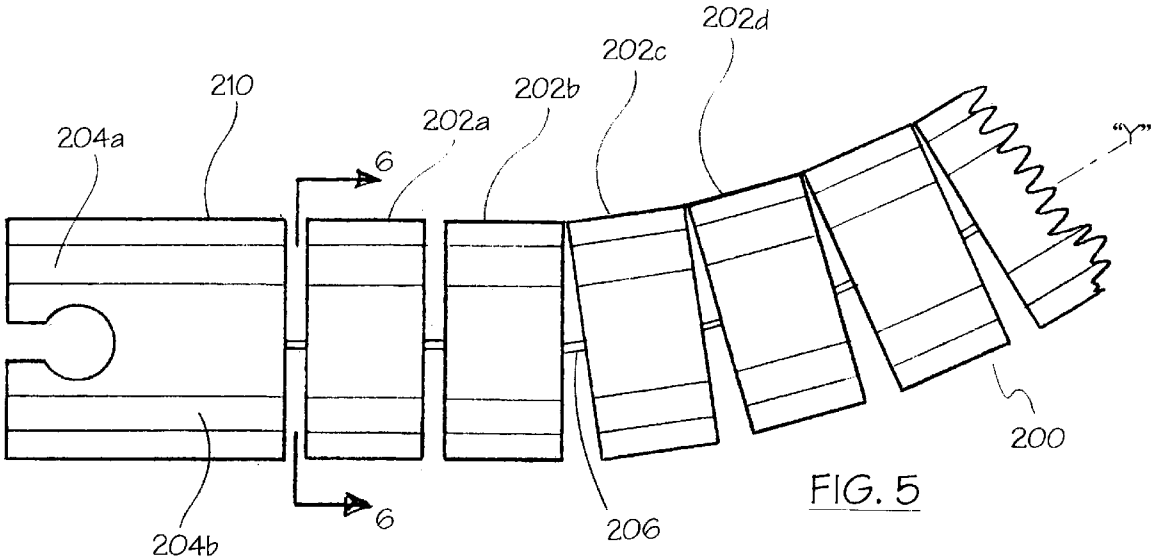
FIG. 5 illustrates a top view of a second embodiment of a toy train track section according to the present disclosure.

Turning to FIG. 5, a top view of a second embodiment of a toy track section 200 is illustrated. Section 200 has a plurality of segments 202(*a*)–(*n*) which collectively form two grooves 204*a* and 204*b* for the opposing wheels of a toy train to ride within. Section 200 terminates in a female connector 208. It is envisioned that a male connector or combination thereof could be utilized to terminate section 200. Band 206 secures and positions each segment 202(*a*)–(*n*) and end connectors. In the preferred embodiment, band 206 is made from a nonstretch flexible material that will not allow end connectors or segments 202(*a*)–(*n*) to substantially rotate about axis "y".

Still referring to FIG. 5, section 200 flexes into various arcs and linear segments to create a desired pattern. Despite flexing of section 200, grooves 204*a* and 204*b* still effectively guide opposing wheels of a toy across the entire length of section 200.

Figure 6:
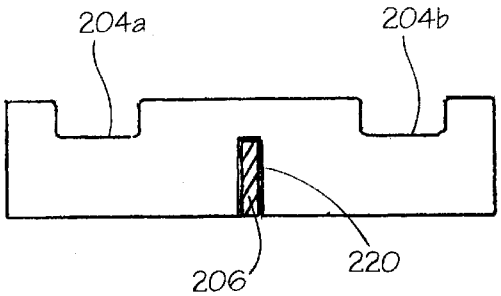
FIG. 6 illustrates a cross-section view taken along line 6—6 of FIG. 5.

Referring now to FIG. 6, a cross-sectional view along line 6—6 of FIG. 5 is illustrated. Segment 202*a* has a rectangular notch 220 which is adapted to receive band 206. Preferably, the edge of band 206 is permanently glued into notch 220 along the entire length of each segment 202(*a*)–(*n*). Although not shown, it will be appreciated that each segment 202(*a*)–(*n*) and the opposing end connectors define rectangular notches and are also glued to band 206. Preferably, band 206 is rectangularly shaped in order to help prevent segments 202(*a*)–(*n*) from rotating.

Figure 7:
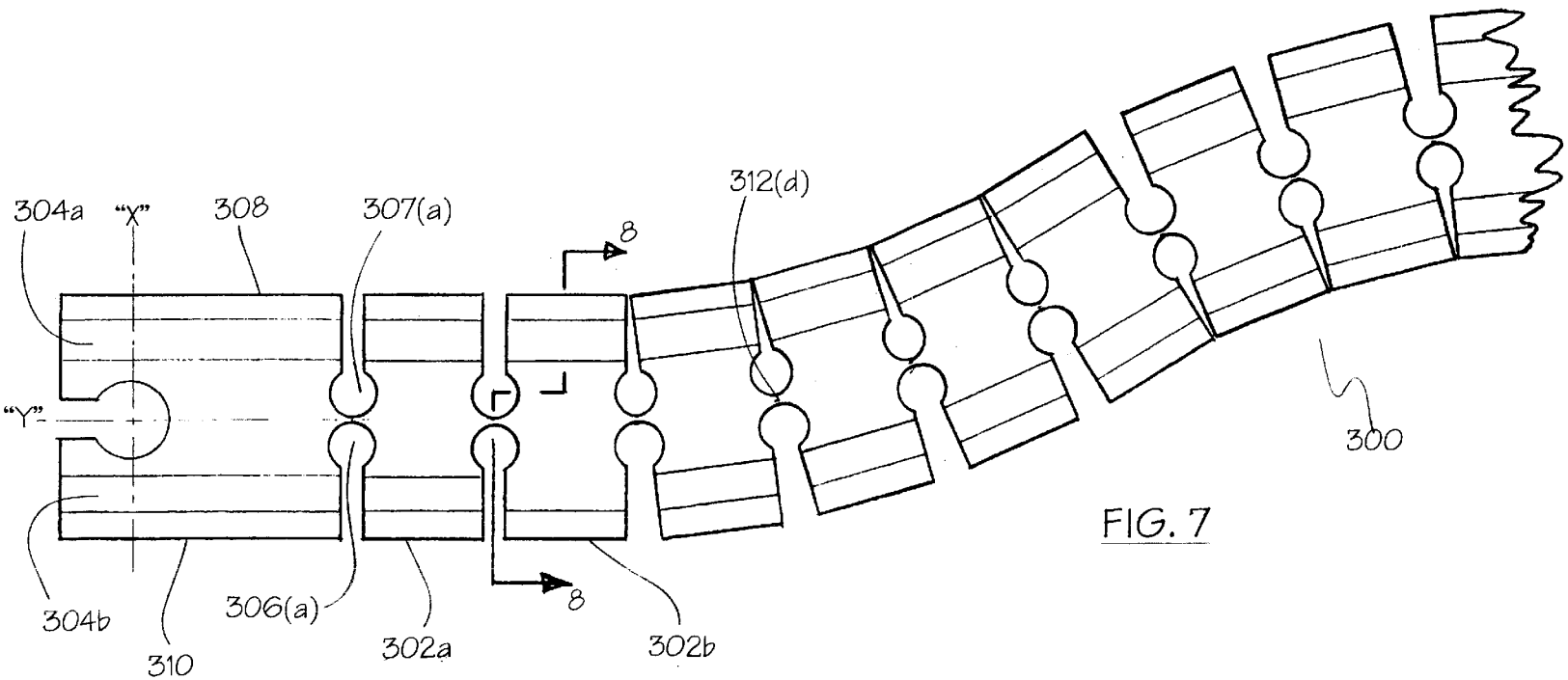
FIG. 7 illustrates a top view of a third embodiment of a toy train track section according to the present disclosure.

Turning to FIG. 7, a top view of a third embodiment of a toy track section 300 is illustrated. Although monolithic, section 300 has a plurality of segments 302(*a*)–(*n*) which collectively form two grooves 304*a* and 304*b* for the opposing wheels of a toy train to ride within. Section 300 terminates in a female connector 308. It is envisioned that a male connector or combination could be utilized to terminate section 300. In a preferred embodiment, section 300 may be fabricated from a variety of materials such as molded plastic, wood, metal or the like.

Figure 8:
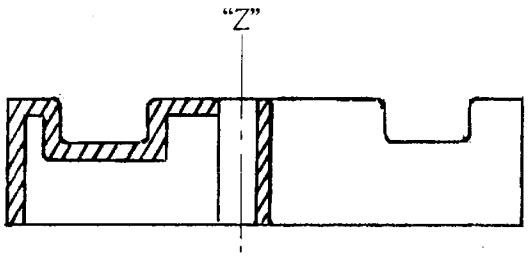
FIG. 8 illustrates a cross-section view taken along line 8—8 of FIG. 7.

Still referring to FIG. 7, pairs of opposed key-shaped slots 306(*a*)–(*m*) and 307(*a*)–(*m*) separate segments 302(*a*)–(*n*). When toy train section 300 is linear along axis "y", slots 306(*a*)–(*m*) and 307(*a*)–(*m*) are perpendicular to the plane defined by the "x" and "y" axis. Diametrical webs 312(*a*)–(*m*) remain to connect each pair of opposing slots 306(*a*)–(*m*) and 307(*a*)–(*m*). As a result, each segment 302(*a*)–(*n*) will rotate about the "z" axis as shown in FIG. 8. As a result, section 300 can also be shaped into various arcs and linear segments to create a desired pattern and despite flexing section 300, grooves 304*a* and 304*b* still effectively guide opposing wheels of a toy across the entire length of section 300.

Figure 9:
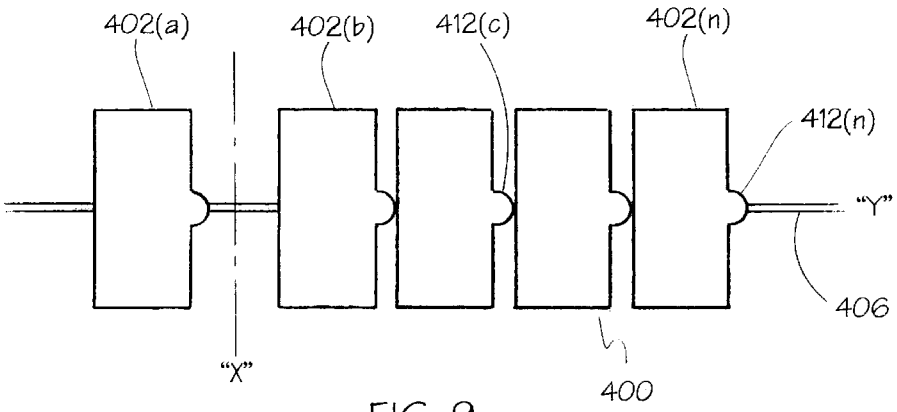
FIG. 9 illustrates a top view of a fourth embodiment of a toy train track section according to the present disclosure.

In a further embodiment of the present disclosure, FIG. 9 depicts a top view of a toy train track section designated generally by reference numeral 400. Track section 400 has a plurality of segments 402(*a*)–(*n*) which collectively form grooves to guide a toy train. The variable "n" represents the numbers of segments and is in no way intended to limit the length of track section 400. A cable 406 secures and aligns each segment 402(*a*)–(*n*) in position along axis "y".

Still referring to FIG. 9, segments 402(*a*)–(*n*) can rotate about cable 406. Segments 402(*a*)–(*n*) are substantially rectangular in shape. Protrusion 412(*a*)–(*n*) on each segment provides spacing between segments 402(*a*)–(*n*) in order to allow the track section 400 to flex into arcs while maintaining a groove to guide a toy. Protrusions 412(*a*)–(*n*) may be of any functional shape, e.g., dome, hemi-tubular and the like.

In another embodiment, each segment 402(*a*)–(*n*) may have a hollow to complement each protrusion. Hollows may be of any functional shape, e.g., cone, trough and the like. In still another embodiment, each segment 402(*a*)–(*n*) may be ferrous and each protrusion 412(*a*)–(*n*) may be magnetic. Therefore, segments 402(*a*)–(*n*) can remain attached without having a cable therethrough. It is envisioned that the end segments of track section 400 may have protrusions to maintain spacing and further be adapted to engage other segments by any sufficient means.

Figure 10:
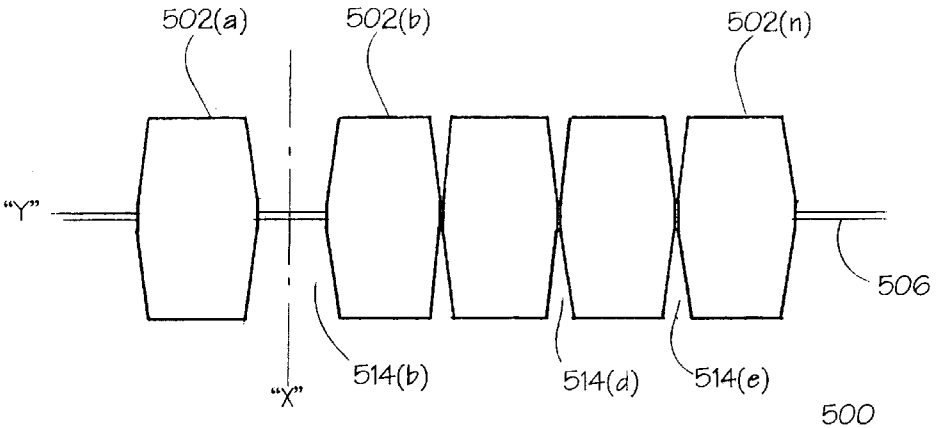
FIG. 10 illustrates a top view of a fifth embodiment of a toy train track section according to the present disclosure.

With reference to FIG. 10, a further embodiment of the present disclosure is depicted. Track section 500 has a plurality of segments 502(*a*)–(*n*) which collectively form grooves to guide a toy. The variable "n" represents the numbers of segments and is in no way intended to limit the length of track section 500. A cable 506 secures and aligns each segment 502(*a*)–(*n*) in position along axis "y".

Still referring to FIG. 10, each segment 502(*a*)–(*n*) has six sides, e.g., hexagonal. Two sides of segments 502(*a*)–(*n*) are of equal length and parallel axis y. The remaining four sides are diagonal to axis y to form a point at the location where cable 506 passes through each segment 502(*a*)–(*n*). As a result, gaps 514(*a*)–(*m*) are formed to allow track section 500 to flex into arcs as well as straight sections as desired while maintaining a groove to guide a toy. In another embodiment, each segment 502(*a*)–(*n*) has five sides, e.g., pentagonal. Preferably, pentagonal segments form a point only on one side at the location where cable 506 passes through. It is envisioned that the end segments of track section 500 may have two diagonal sections to create a point to maintain spacing and further be adapted to engage other segments by any sufficient means.

Having thus described several embodiments, it will be observed that at least the following advantages are accomplished. Ease of assembly is achieved by the symmetry of the segments which rotate about a cable and the various end connectors. A multitude of shapes may be formed from a single section. The resulting sophisticated patterns enhance enjoyment from building and playing with the track patterns. Further, the track sections can integrate with conventional pieces to augment and enhance current sets as well as easily solve mismatches.

While the invention has been described with respect to preferred embodiments, those skilled in the art will readily appreciate that various changes and/or modifications can be made to the invention without departing from the spirit or scope of the invention as defined by the appended claims.

What is claimed is:

1. A toy track section comprising:

a plurality of elongated segments, each of the plurality of elongated segments having opposed upper and lower surfaces and an outer peripheral wall extending between the upper and lower surfaces defining opposing lateral wall portions, wherein each of the plurality of elongated segments has a length along a first axis and a width along a second axis, the first axis extending substantially perpendicular to and intermediate the second axis, wherein each of the plurality of segments is permanently attached to one another along the first axis to flex in a substantially horizontal plane defined by the first axis and the second axis, wherein each of said plurality of elongated segments has an elongated central bore extending therethrough for receiving a cable, a single cable for attaching each of the plurality of segments to one another, the single cable extending through the elongated central bore of each of said plurality of elongated segments such that each of the plurality of elongated segments is permanently mounted to move axially and rotationally about the cable.

2. A toy track section as recited in claim 1, further comprising a first end connector and a second end connector, wherein each end of said cable is clamped within a bore defined in said first end connector and said second end connector, respectively.

3. A toy track section as recited in claim 2, further comprising a plurality of collars for increasing the toy track section's ability to flex, the collars mounted on said cable between each of the said plurality of elongated segments.

4. A toy track section as recited in claim 1, wherein each of said plurality of elongated segments include two substantially identical pieces.

5. A toy track section as recited in claim 4, wherein said two substantially identical pieces are glued together to capture a cable.

6. A toy track section as recited in claim 1, wherein said upper surface and said lower surface define substantially identical profiles for allowing a toy to travel bidirectionally along the upper surface and the bottom surface interchangeably.

7. A toy track section as recited in claim 1, wherein said outer peripheral wall defines a rectangular shape.

8. A toy track section as recited in claim 1, further comprising a first end connector and a second end connector for engaging adjacent toy track sections.

9. A toy track section as recited in claim 8, wherein said first end connector is female and said second end connector is male.

10. A toy track section as recited in claim 8, wherein said first end connector terminates and said second end connector terminate in magnetic material.

11. A toy track section as recited in claim 1, wherein the toy track section is configured to reflex outside of the substantially horizontal plane.

12. A toy track section for play on a substantially planar surface, comprising:

a plurality of spaced segments, each of said plurality of spaced segments defining a first groove for guiding a toy in a top surface thereof, a second groove suitable for guiding a toy in a bottom surface thereof and an orifice formed therethrough, wherein each of the plurality of spaced segments abuts each adjacent segment;

a cable extending through said orifices formed through said plurality of segments;

a first end connector having a bore for capturing a first end of said cable; and a second end connector having a bore for capturing a second end of said cable, wherein by capturing the cable the first and second end connectors permanently couple each of the plurality of spaced segments together, wherein said cable permits said plurality of segments to flex relative to each other on the substantially planar surface, to move independently along the cable, and to independently rotate about the cable for allowing the bottom surface of each of the plurality of segments to be selectively positioned upwards for ease of use.

* * * * *

UNITED STATES PATENT AND TRADEMARK OFFICE

CERTIFICATE OF CORRECTION

PATENT NO. : 6,398,121 B1
DATED : June 4, 2002
INVENTOR(S) : Morgan

It is certified that error appears in the above-identified patent and that said Letters Patent is hereby corrected as shown below:

Column 7,
Lines 4-6, Claim 11 should read -- 11. A toy train track section as recited in claim 1, wherein the toy train track is configured to flex outside of the substantially horizontal plane. --

Signed and Sealed this

Fifteenth Day of October, 2002

*Attest:*

*Attesting Officer*

JAMES E. ROGAN
*Director of the United States Patent and Trademark Office*